United States Patent [19]

Stedman

[11] 4,053,075

[45] Oct. 11, 1977

[54] HIGH LIFT MOUNTING MEANS FOR LOADER BUCKETS

[75] Inventor: Robert N. Stedman, Chillicothe, Ill.

[73] Assignee: Caterpillar Tractor Co., Peoria, Ill.

[21] Appl. No.: 718,732

[22] Filed: Aug. 30, 1976

[51] Int. Cl.[2] ..... E02F 3/74

[52] U.S. Cl. ..... 214/770; 182/2; 214/776

[58] Field of Search ..... 214/140, 769, 770, 773, 214/774, 775, 776; 212/8 R, 55, 58 R, 59 R, 35 R; 182/2, 141

[56] References Cited

U.S. PATENT DOCUMENTS

| | | | |
|---|---|---|---|
| 2,865,523 | 12/1958 | Morrison | 212/55 X |
| 3,252,542 | 5/1966 | Thornton-Trump | 182/2 |
| 3,557,967 | 1/1971 | Madole | 212/55 |
| 3,703,973 | 11/1972 | Nilsson | 214/770 X |
| 3,708,037 | 1/1973 | Tranchero | 182/2 |
| 3,828,939 | 8/1974 | Tranchero | 182/2 X |

*Primary Examiner*—L. J. Paperner
*Attorney, Agent, or Firm*—Phillips, Moore, Weissenberger, Lempio & Majestic

[57] ABSTRACT

A loader comprises means mounting a loader bucket thereon for selectively moving the bucket substantially vertically between lowered and raised positions thereof. Such mounting means comprises first, second and third pairs of lift arms pivotally interconnected between a frame of the vehicle and the loader bucket and a double-acting hydraulic cylinder pivotally interconnected between the frame and each first lift arm to selectively raise or lower the loader bucket. Linkage means are pivotally interconnected between the frame of the vehicle and the first, second and third lift arms for expanding the linkage means from a collapsed position on the vehicle to an expanded position when the loader bucket is moved to its raised position. A tilt linkage is pivotally interconnected between the second and third lift arms and the loader bucket for selectively tilting the same relative to ground level.

9 Claims, 4 Drawing Figures

12
23
39
21
41
42
35
34
37
22
36
31
38
33
19
29
20
26
43
30
32
28
18
14
11
15
16
25
17
27

HIGH LIFT MOUNTING MEANS FOR LOADER BUCKETS

BACKGROUND OF THE INVENTION

The reach achieved by conventional loaders is normally limited due to the construction and arrangement of the lift arms and associated tilt linkages employed thereon. Attempts to increase such reach by increasing the overall length of the lift arms has created obvious problems relating to work capabilities and stabilization of the vehicle. Further attempts to modify conventional lift arms and tilt linkages have resulted in complex apparatus, the costs of which are prohibited and which do not always assure the operating desiderata intended.

SUMMARY OF THIS INVENTION

An object of this invention is to provide an economical and non-complex means for mounting a work tool on a frame of a vehicle whereby the work tool may be selectively moved substantially vertically between lowered and raised positions. Such mounting means finds particular use on loaders wherein the work tool constitutes a loader bucket adapted to be lowered to ground level for earth digging or crowding purposes or raised for unloading or transport purposes.

The mounting means is preferably constructed and arranged to comprise first, second and third lift arm means pivotally interconnected together with the first lift arm means being pivotally mounted on the frame of the vehicle. Actuating means, such as double-acting hydraulic cylinder, is pivotally interconnected between the frame and the first lift arm means to selectively raise and lower the same. Linkage means are pivotally interconnected between the frame and the first, second and third lift arm means for expanding the linkage means from a collapsed position in response to extension of the actuating means to raise the first arm means.

When in its collapsed position, the third lift arm means preferably rests on the first lift arm means to thus transmit digging forces imposed on the loader bucket to the frame of the vehicle directly therethrough. Such collapsed disposition of the third lift arm means on the first lift arm means will be maintained until the first lift arm means is raised to a generally horizontal disposition by the actuating means whereafter the linkage means will take over to move the work tool substantially vertically to its fully raised position. The mounting means is adapted to maintain the composite center of gravity with the loader bucket substantially over the vehicle to assure full stability thereof.

BRIEF DESCRIPTION OF THE DRAWINGS

Other objects of this invention will become apparent from the following description and accompanying drawings wherein.

DETAILED DESCRIPTION

Figure 1:
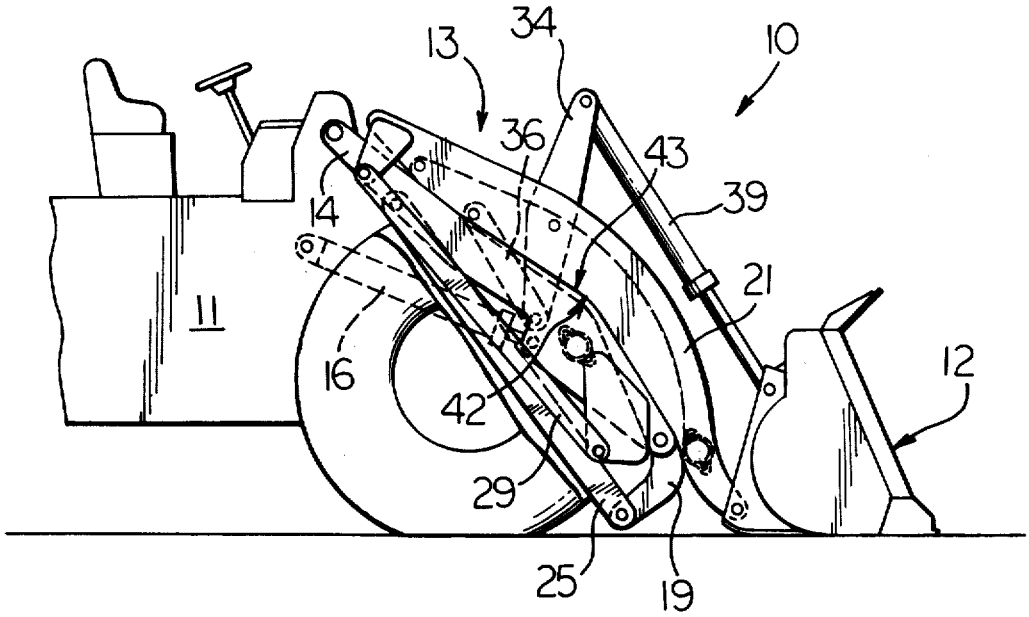
FIG. 1 is a side elevational view of the forward portion of a loader having the mounting means of this invention mounting a loader bucket thereon.
Figure 2:
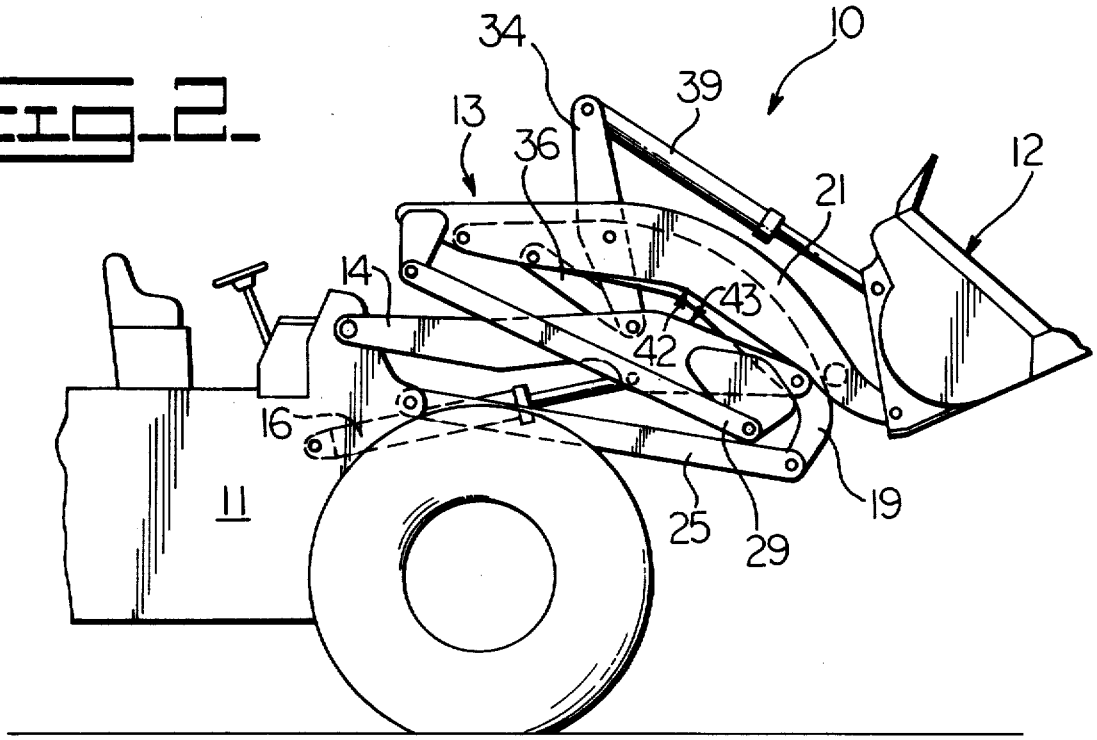
FIG. 2 is a view similar to FIG. 1, but illustrating the loader bucket in a partially raised position.

FIGS. 1–4 illustrate a construction vehicle 10, preferably a wheel loader, comprising a frame 11 having a loader bucket 12 mounted thereon by mounting means 13 of this invention. Although the mounting means finds particular application for mounting the illustrated loader bucket on the forward end of a tractor, it should be understood that other types of work tools may be mounted on other types of construction vehicles by such mounting means. In the wheel loader application illustrated, loader bucket 12 is adapted to be moved substantially vertically between its lowered and ground engaging position illustrated in FIG. 1 to its fully raised position illustrated in FIGS. 3 and 4.

Referring to the latter two figures, the mounting means comprises first lift arm means in the form of a pair of laterally spaced first lift arms 14 each pivotally mounted on frame 11 at a first end thereof by a pin 15. An actuating means, preferably in the form of a double-acting hydraulic cylinder 16, is pivotally interconnected between the frame and each first lift arm 14 by pivot pins 17 and 18, respectively. Second lift arm means comprise a pair of laterally spaced second lift arms 19 each having a first end thereof pivotally connected to a second end of a respective lift arm 14 by a pin 20.

Third lift arm means comprise a pair of laterally spaced third lift arms 21 each having a first end thereof pivotally connected to a second end of a respective second lift arm 19 by a pin 22. A second end of each third lift arm is pivotally connected to loader bucket 12 by a pin 23. Tubular cross braces 24 may be secured between the second ends of first and third lift arms 14 and 21 to increase the overall structural rigidity of the integrated arrangement.

Linkage means pivotally interconnected between frame 11 and first, second and third lift arm means 14, 19, and 21 for expanding mounting means 13 from its FIG. 1 collapsed condition to its FIG. 3 condition will now be described. Such linkage means comprises a pair of first links 25 each pivotally interconnected between frame 11 and an extension 26 of the first end of a respective second arm 19 by pins 27 and 28, respectively. A pair of links 29 are each pivotally interconnected between an extension plate 30 secured to the second end of a respective first lift arm 14 and an extension plate 31 secured to the first end of a respective third lift arm 21 by pins 32 and 33, respectively.

Tilt linkage means for selectively pivoting loader bucket 12 on each third lift arm 21 comprises a bellcrank 34 pivotally mounted intermediate its ends on the third lift arm by a pin 35. A link 36 is pivotally interconnected between a first end of the belrank and a second end of a respective second lift arm 19 by pins 37 and 38, respectively. A double-acting hydraulic cylinder 39 is pivotally interconnected between a back side of loader bucket 12 and a second end of bellcrank 34 by pins 40 and 41, respectively.

From the above description, it can be seen that upon collapse of mounting means 13 to place loader bucket 12 in its lowered and ground engaging position illustrated in FIG. 1, that third lift arms 21 will overlie and rest directly upon first lift arms 14. In particular, the underside of each third lift arm 21 is arcuate (concave), as indicated at 42 to rest on an accommodating arcuate (concave) upper side 43 of a respective first lift arm 14. Upon extension of cylinders 16, the third lift arms will tend to "roll-on" the first lift arms to be raised thereby until the first lift arms pivot upwardly to the generally horizontal disposition illustrated in FIG. 2.

Figure 3:
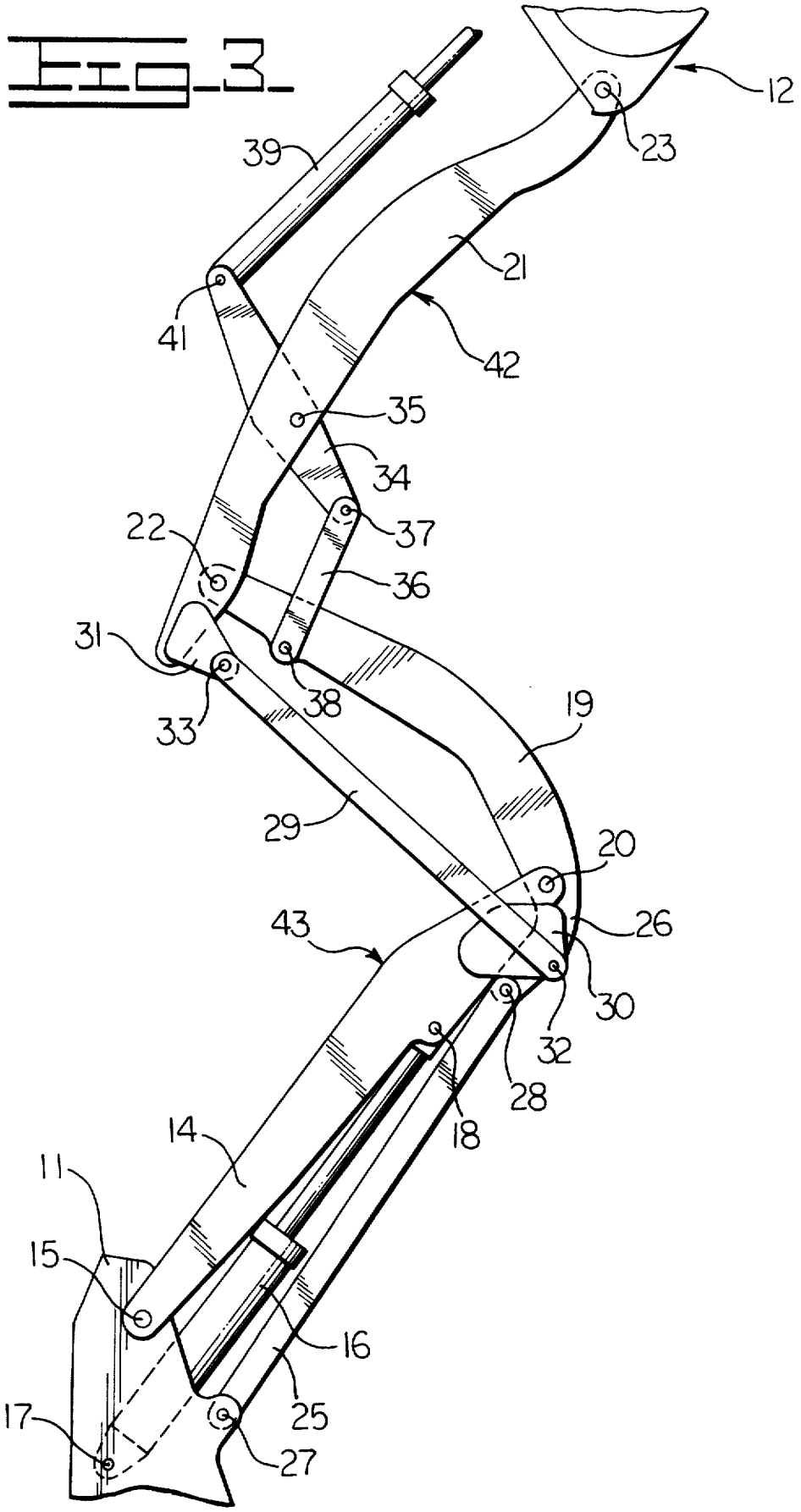
FIG. 3 is a similar but enlarged view, illustrating the loader bucket in its fully raised position.
Figure 4:
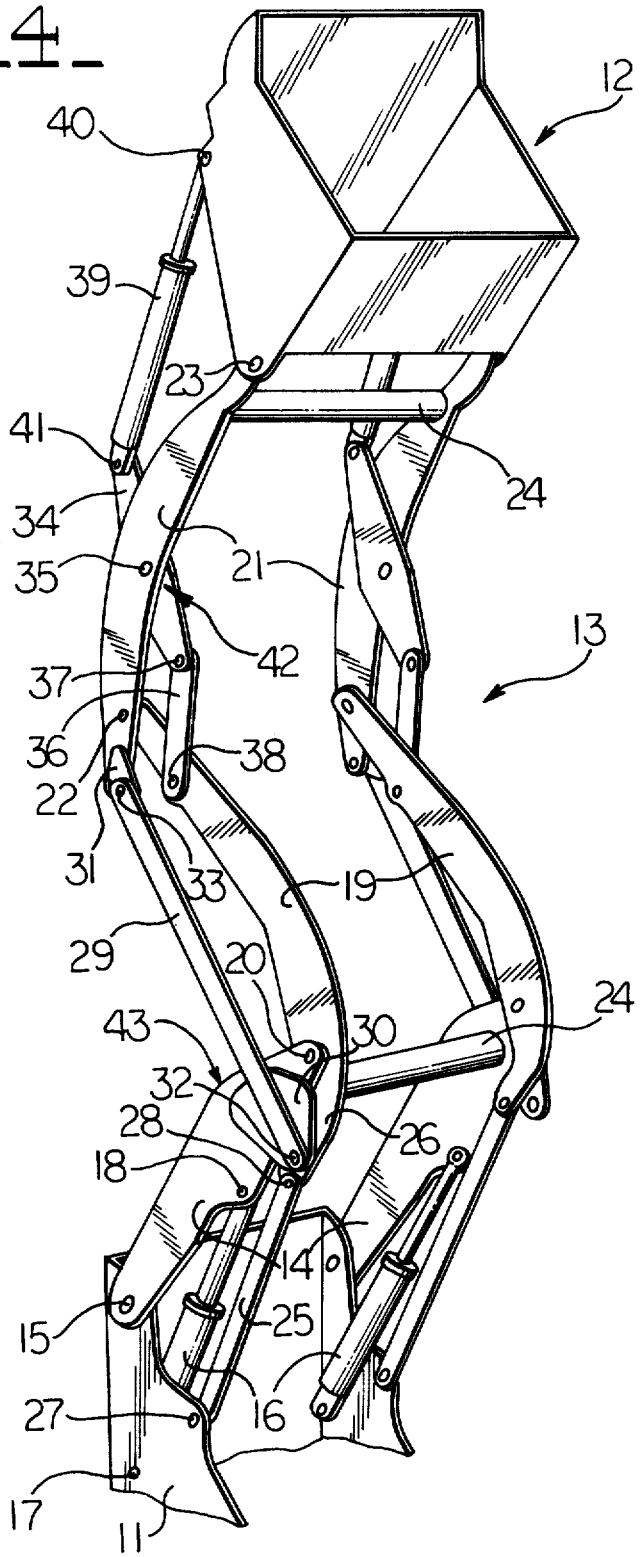
FIG. 4 is a front isometric view illustrating the loader bucket in its fully raised position.

Thereafter, the third lift arms will move out of contact with the first lift arms under influence of the above-described linkage means and such linkage means will take over to fully extend the mounting means to raise the loader bucket fully upwardly, as illustrated in FIGS. 3 and 4. It should be noted that the collapsed disposition of the third lift arms on the first lift arms, as illustrated in FIG. 1, provides that digging forces and the like imposed on the bucket will be, in turn, transmitted directly to frame 11 of the vehicle via the first and third lift arms. The second lift arms are disposed on inboard sides of the connected first and third lift arms to facilitate such a collapsed condition of the mounting means.

What is claimed is

1. A construction vehicle comprising a frame, a work tool, and mounting means mounting said work tool on said frame for selectively moving said work tool substantially vertically between lowered and raised positions on said vehicle comprising first lift arm means having a first end thereof pivotally mounted on said frame, extensible and retractable actuating means interconnected between said frame and said first lift arm means for selectively raising and lowering said first lift arm means, second lift arm means having a first end thereof pivotally connected to a second end of said first lift arm means, third lift arm means having a first end thereof pivotally connected to a second end of said second lift arm means and having a second end thereof connected to said work tool, and linkage means pivotally interconnected between said frame and said first, second and third lift arm means for expanding said mounting means from a collapsed condition on said vehicle in response to extension of said actuating means to raise said first lift arm means, said third lift arm means resting directly upon said first lift arm means when said mounting means is in its collapsed condition and wherein said linkage means begins separating said first and third lift arm means from each other when said first lift arm means is disposed approximately horizontally upon raising thereof by said actuating means.

2. The construction vehicle of claim 1 wherein said work tool constitutes a loader bucket pivotally mounted on said third lift arm means.

3. The construction vehicle of claim 2 further comprising tilt linkage means pivotally interconnected between said loader bucket and said second and third lift arm means for selectively pivoting said loader bucket on said third lift arm means.

4. The construction vehicle of claim 3 wherein said tilt linkage means comprises a bellcrank pivotally mounted intermediate its ends on said third lift arm means, a link pivotally interconnected between a first end of said bellcrank and said second lift arm means and a double-acting hydraulic cylinder pivotally interconnected between a second end of said bellcrank and said loader bucket.

5. The construction vehicle of claim 1 wherein said first lift arm means comprises a pair of laterally spaced first lift arms, said second lift arm means comprises a pair of laterally spaced second lift arms each pivotally connected to a respective one of said first lift arms and said third lift arm means comprises a pair of laterally spaced third lift arms each pivotally connected to a respective one of said second lift arms.

6. The construction vehicle of claim 5 wherein said actuating means comprises a double-acting hydraulic cylinder pivotally interconnected between said frame and each of said first lift arms.

7. The construction vehicle of claim 5 wherein each of said second lift arms is disposed on inboard sides of the first and third lift arms connected thereto.

8. The construction vehicle of claim 5 wherein an upper side of each of said first lift arms and an underside of each of said third lift arms are each arcuate and wherein the underside of each of said third lift arms rests and is accommodated upon the upper side of a respective one of said first lift arms when said mounting means is in its collapsed condition whereby forces imposed on said work tool will be transmitted to the frame of said vehicle through said first and third lift arms.

9. The construction vehicle of claim 5 wherein said linkage means comprises a first link pivotally interconnected between said frame and the first end of each of said second lift arms and a second link pivotally interconnected between the second end of each of said first lift arms and the first end of each of said third lift arms.

* * * * *